United States Patent [19]

Pitkanen

[11] 4,248,008

[45] Feb. 3, 1981

[54] BALLOON EJECTING DEVICE

[76] Inventor: Alan R. Pitkanen, 3120 Ocean Dr., Manhattan Beach, Calif. 90266

[21] Appl. No.: 69,810

[22] Filed: Aug. 27, 1979

[51] Int. Cl.[3] ..... A63H 3/06

[52] U.S. Cl. ..... 46/88

[58] Field of Search ..... 46/88, 87, 89, 84, 44, 46/76 A, 56; 124/62

[56] References Cited

U.S. PATENT DOCUMENTS

| | | | |
|---|---|---|---|
| 1,618,856 | 2/1927 | Abrams et al. | 46/84 |
| 2,553,941 | 5/1951 | Raab | 46/88 |
| 3,025,634 | 3/1962 | Barricks | 46/88 |
| 4,134,228 | 1/1979 | Ortiz | 46/88 |
| 4,149,338 | 4/1979 | Wolf | 46/88 X |

FOREIGN PATENT DOCUMENTS

| | | | |
|---|---|---|---|
| 281166 | 12/1914 | Fed. Rep. of Germany | 46/88 |

*Primary Examiner*—Gene Mancene
*Assistant Examiner*—Mickey Yu
*Attorney, Agent, or Firm*—Keith D. Beecher

[57] ABSTRACT

A pistol-like device for ejecting toy balloons is provided which rapidly spins an inflated balloon and then releases the balloon while it is still spinning. The device thereby provides a spin stabilization to the balloon which causes the balloon to follow a prescribed course while being propelled by the air jet issuing from the neck of the balloon as the air within the balloon escapes.

10 Claims, 2 Drawing Figures

BALLOON EJECTING DEVICE

BACKGROUND

Toy balloon ejecting pistols are known. U.S. Pat. No. 3,025,634, for example, discloses a toy balloon ejecting pistol which includes an airtight tubular portion having a mouthpiece at one end and a valve at the other end. A toy balloon is fitted over the valve. The balloon is inflated by blowing air through the mouthpiece and through the valve into the interior of the balloon, the valve acting to prevent the air in the interior of the balloon from escaping. By pulling a trigger, the balloon is separated from the pistol and the air in the balloon rushes out through the neck which causes the balloon to take flight. A similar type of balloon ejecting device is illustrated and described in U.S. Pat. No. 4,134,228.

However, the balloons ejected from the devices described in the prior art patents referred to in the preceding paragraph are propelled along wild and random flight paths. An important objective of the present invention is to provide a balloon ejecting device which is constructed to impart a rapid spin to the inflated balloon prior to ejection, so that the balloon upon leaving the device is rapidly spinning about its longitudinal axis. This causes the balloon to travel along a given, straight, predictable and prescribed flight path under the propulsion force of the air being emitted through its neck.

An important feature of the invention is that the pistol can be aimed at a given target and then fired to eject the inflated balloon and cause it to travel along a straight flight path toward the target. However, the projected balloon cannot harm the target, so that children can safely play with the pistol without any danger of harm to themselves or to their friends towards which the balloon projectiles may be fired.

In essence, the invention provides a toy balloon ejecting pistol-like device which imparts a rapid spin to an inflated balloon about its longitudinal axis prior to ejection of the balloon, and which releases the balloon while it is rapidly spinning to impart spin stabilization to the balloon. This stabilization maintains the balloon on its prescribed course while the balloon is being propelled along that course by the air jet issuing from its neck as the air within the balloon escapes.

DETAILED DESCRIPTION OF THE ILLUSTRATED EMBODIMENT

Figure 1:
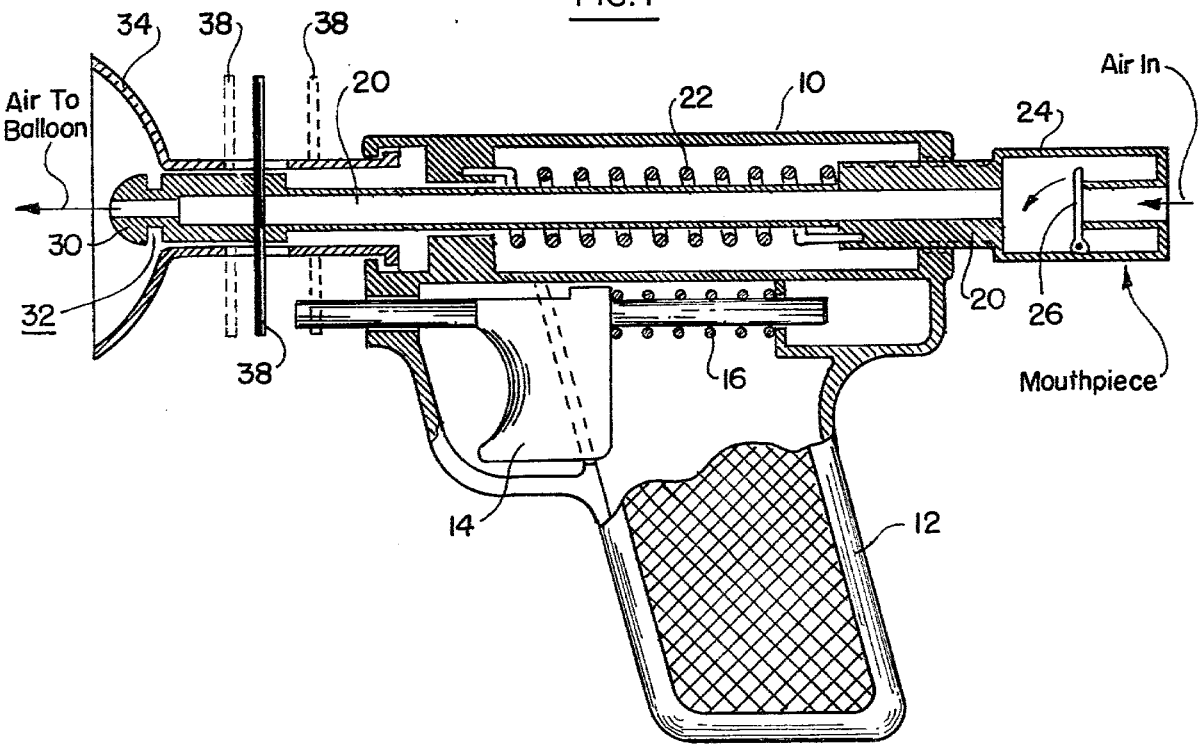
FIG. 1 is a cross-sectional view of a preferred embodiment of the pistol-like balloon ejecting device of the invention.

The pistol-like device of FIG. 1 includes a tubular housing 10. A pistol grip 12 is attached to the housing 10, and a trigger 14 is slidably mounted within the pistol grip. A spring 16 normally biases the trigger to the left in FIG. 1. An air tube 20 is rotatably mounted in housing 10. Specifically, the right-hand end of the air tube is threaded to the corresponding end of the housing. A torsional spring 22 is connected to one end to housing 10, and at the other end to the air tube 20.

Figure 2:
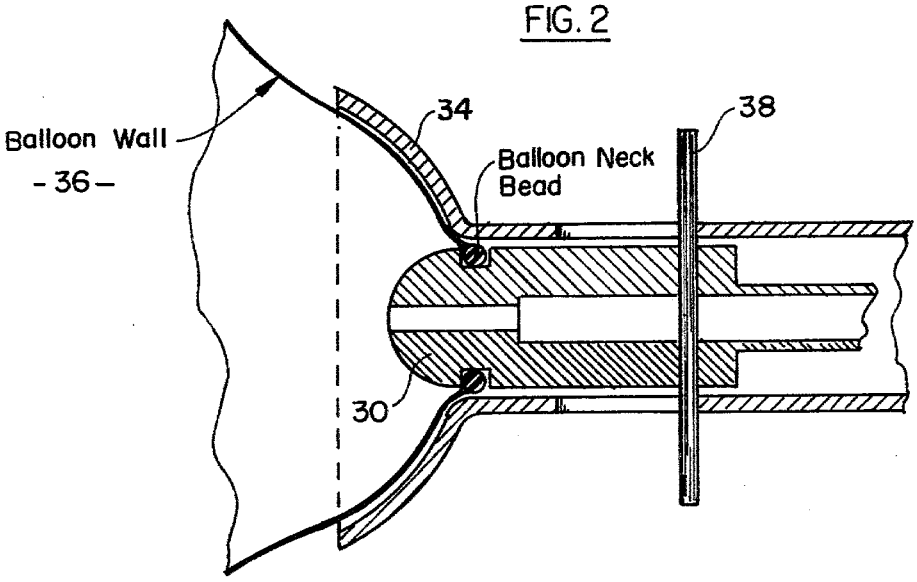
FIG. 2 is a fragmentary section of the device of FIG. 1, showing a balloon releasably held in the device.

A mouthpiece 24 is formed at the right-hand end of the air tube 20. An unidirectional valve 26 is mounted within the mouth piece, and the valve is normally spring-biased to a closed position. A nozzle 30 is mounted on the other end of air tube 20, and the nozzle includes a peripheral groove 32 which serves to receive the neck of a balloon 36, as shown in FIG. 2.

A balloon positioning and locking sleeve 34 is rotatably mounted in the forward end of the housing 10, and the sleeve is movable axially a limited extent with respect to the housing. A pin 38 extends through the air tube 20 and through slots in the sleeve. The pin projects adjacent to the forward end of trigger 14, so that rotation of the pin, and therefore of sleeve 34 and air tube 20, is normally prevented by the trigger. However, when the trigger is pulled to the right in FIG. 1 against the force of spring 16, pin 38 is released, and the air tube 20 and sleeve 34 are free to spin about the longitudinal axis of the air tube.

In the operation of the device, the neck of the balloon 36 is inserted into the peripheral groove 32 in nozzle 30, while the nozzle is in the position shown in FIG. 1.

Pin 38 is then turned, to turn the air tube 20 and to wind up spring 22. As the air tube 20 is rotated relative to housing 10, it moves axially to the right in FIG. 1 due to its threaded engagement with the right-hand end of the housing. This draws the pin 38 to the right-hand position shown by the broken lines in FIG. 1, which is the fully cocked position. The peripheral groove 32 has been drawn into the confines of the locking sleeve 34 in this position as is shown in FIG. 2. The pin 38 then engages the forward end of trigger 14, and the pistol is loaded. The balloon then may be inflated by blowing air in through the mouthpiece 28 and past the valve 26. After the balloon has been inflated, the trigger 14 may be actuated to release pin 38. The release of pin 38 causes the air tube 20 and sleeve 34 to spin rapidly about the longitudinal axis of the air tube and, likewise, causes the inflated balloon to spin about its longitudinal axis.

As the air tube 20 spins, it moves forward to the left of FIG. 1, due to its threaded engagement with the housing 10, so that the pin 38 reaches the forward position shown by the broken lines in FIG. 1, to release the spinning balloon. It should be noted that when the trigger 14 is first actuated, both the sleeve 34 and air tube 20 move together forward to the left in FIG. 1 as they spin around the spin axis. This forward motion continues until the right-hand end of the sleeve engages the left-hand end of housing 10, so that further forward motion of the sleeve is prevented. The air tube 20, however, continues its forward motion and pin 38 moves towards the front of the slots in the sleeve to the position shown in FIG. 1, so that the peripheral groove 32 moves out of the forward end of sleeve 34, and the spinning balloon is released from the nozzle 30. As soon as the spinning balloon is released, the air within the balloon escapes out through its neck as an air jet, and the balloon is propelled thereby along its prescribed path as a projectile.

The invention provides, therefore, a pistol-like device, whereby toy balloons may be ejected and directed along prescribed straight paths towards a target, this being achieved by causing the balloon to spin rapidly about a spin axis prior to its being ejected by the device.

It will be appreciated that while a particular embodiment of the pistol-like device has been shown and described, modifications may be made. It is intended in the claims to cover the modifications which come within the spirit and scope of the invention.

What is claimed is:

1. A device for ejecting a toy balloon comprising: a housing; an elongated air tube rotatably mounted in the housing for rotation about its longitudinal axis; nozzle means mounted at one end of the air tube for receiving the neck of a toy balloon; a mouthpiece mounted at the other end of the air tube for permitting air to be blown into the interior of the balloon; torsional spring means connected to the air tube and to the housing to provide a rotational drive force to the air tube with respect to the housing to cause the air tube to spin about its longitudinal axis after it has been rotated about said axis to wind up the spring means; and trigger means mounted on the housing and engaging said air tube to hold the air tube against rotation after the spring means has been wound up and to release the air tube when the trigger means is actuated.

2. The device defined in claim 1, and which includes uni-directional valve means mounted in the air tube to maintain air in the balloon after the air has been blown into the interior of the balloon through the air tube.

3. The device defined in claim 1, and which includes a locking sleeve mounted on the housing in concentric relationship with the nozzle means for maintaining the neck of the balloon on said nozzle means until the spring means has been released.

4. The device defined in claim 3, in which the air tube is threaded to the housing to move axially with respect to the housing when released by said trigger means to cause the air tube to move axially with respect to the locking sleeve to release the neck of the balloon from the nozzle means.

5. The device defined in claim 1, and which includes a pistol grip mounted on said housing, and in which said trigger means is mounted adjacent to said pistol grip.

6. The device defined in claim 4, in which said sleeve is rotatably mounted on said housing, and which includes a pin mounted on said air tube and extending radially outwardly therefrom through a slot in said locking sleeve, said pin and said locking sleeve rotating about the longitudinal axis of said air tube as said air tube is rotated about said axis, said trigger means normally engaging said pin and releasing said pin when the trigger means is actuated.

7. The device defined in claim 6, in which said slot extends longitudinally along said sleeve to permit axial movement of said nozzle means relative to said sleeve upon rotation of said air tube to release the balloon.

8. A device for ejecting a toy balloon comprising: a housing; a member mounted in said housing for rotation about a spin axis; means for releasably mounting a toy balloon on said member; means coupled to said member for imparting rotation to said member about the spin axis; and trigger means coupled to said member for preventing said member to spin about the spin axis until said trigger means is actuated, and for enabling the mounting means to release the balloon when said trigger means has been actuated and said member is spinning about the spin axis.

9. The device defined in claim 8, in which said member comprises an elongated air tube through which air may be blown into the interior of the balloon.

10. The device defined in claim 9, and which includes nozzle means mounted at one end of said air tube for holding the neck of the balloon within said releasable mounting means, and a mouthpiece mounted at the other end of said air tube, and which further includes unidirectional valve means mounted in said air tube.

* * * * *